US009737149B2

(12) United States Patent
Heidlage et al.

(10) Patent No.: US 9,737,149 B2
(45) Date of Patent: Aug. 22, 2017

(54) HEIGHT ADJUSTABLE BED FRAMEWORK WITH A LIFT CHAIN AND A PLANETARY GEAR TRAIN

(75) Inventors: John K. Heidlage, Hamilton, OH (US); David W. Hornbach, Brookville, IN (US); Stephen Hutchison, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 1056 days.

(21) Appl. No.: 12/879,699

(22) Filed: Sep. 10, 2010

(65) Prior Publication Data

US 2012/0060276 A1 Mar. 15, 2012

(51) Int. Cl.

*A61G 13/06* (2006.01)
*A47C 19/04* (2006.01)
*A61G 7/012* (2006.01)

(52) U.S. Cl.

CPC ..... *A47C 19/045* (2013.01); *A61G 7/012* (2013.01)

(58) Field of Classification Search

CPC ..... A61G 7/00; A61G 7/005; A61G 7/012; A61G 13/04; A61G 13/06
USPC ..... 5/613, 616, 617, 618, 11, 611, 80, 8, 74, 5/309
See application file for complete search history.

(56) References Cited

U.S. PATENT DOCUMENTS 2,692,169 A * 10/1954 Phillips ..... 52/121
2,739,785 A * 3/1956 Gray ..... 5/510
3,230,553 A * 1/1966 Schlackman et al. ..... 5/611
3,302,022 A * 1/1967 Brenner et al. ..... 378/179
3,686,978 A * 8/1972 Knoblach ..... B60K 17/046 475/296
3,820,176 A * 6/1974 Feiertag ..... 5/611
3,831,455 A * 8/1974 Patrignani ..... 74/89.21
4,014,136 A * 3/1977 Hemens et al. ..... 49/325
4,092,946 A * 6/1978 Kappas ..... B63H 20/007 440/6
4,180,222 A * 12/1979 Thornburg ..... B64C 9/06 244/215
4,452,429 A * 6/1984 Muessel ..... B66D 1/22 254/344
4,513,805 A * 4/1985 Mase ..... E06B 9/80 160/299

(Continued)

FOREIGN PATENT DOCUMENTS

JP 2004129932 A 4/2004

OTHER PUBLICATIONS

Douglas Wright, Epicyclic Gear Train, Dec. 2005, mdp.eng, Dec. 2005, http://www-mdp.eng.cam.ac.uk/web/library/enginfo/textbooks_dvd_only/DAN/gears/epicyclic.html#top.*

(Continued)

*Primary Examiner* — Nicholas Polito
*Assistant Examiner* — Ifeolu Adeboyejo
(74) *Attorney, Agent, or Firm* — Kenneth C. Baran

(57) ABSTRACT

A height adjustable bed framework 12 includes a base frame 24, an elevatable frame 30, a lift chain 50 and a power module 52. The lift chain is connected to the base frame or the elevatable frame and the power module is connected to the other frame. The power module includes an energy converter such as an electric motor 90, a planetary gear train 110 driven by the energy converter and a chain driver, such as a sprocket 160, engaged with the lift chain and driven by the planetary gear train.

15 Claims, 6 Drawing Sheets

FIG. 2

(56) References Cited

U.S. PATENT DOCUMENTS 4,589,642 A * 5/1986 Schnelle et al. ..... 5/608
4,830,337 A * 5/1989 Ichiro et al. ..... 254/95
4,838,381 A * 6/1989 Michaud ..... B66F 11/044 182/2.3
4,862,009 A * 8/1989 King ..... F02N 11/04 290/22
4,932,928 A * 6/1990 Crockett ..... F16H 47/085 475/47
5,013,018 A * 5/1991 Sicek et al. ..... 5/601
5,074,000 A * 12/1991 Soltani et al. ..... 5/611
5,131,105 A * 7/1992 Harrawood et al. ..... 5/607
5,156,574 A * 10/1992 Gai ..... 474/155
5,199,391 A * 4/1993 Kovalenko ..... F01C 1/073 123/43 B
5,208,928 A * 5/1993 Kuck et al. ..... 5/608
5,376,057 A * 12/1994 Cooper ..... F16H 1/22 475/248
5,636,394 A * 6/1997 Bartley ..... 5/611
5,896,702 A * 4/1999 Wæhrens ..... 49/325
5,940,911 A * 8/1999 Wang ..... 5/610
6,109,424 A * 8/2000 Doan ..... 198/468.8
6,199,652 B1 * 3/2001 Mastroianni ..... B60K 7/0007 180/229
6,224,037 B1 * 5/2001 Novick ..... 254/95
6,505,365 B1 * 1/2003 Hanson et al. ..... 5/613
6,611,974 B2 * 9/2003 Roit et al. ..... 5/81.1 C
6,678,907 B1 * 1/2004 Voelker et al. ..... 5/611
6,739,004 B1 * 5/2004 Abrahamsen et al. ..... 5/610
6,811,510 B1 * 11/2004 Langenfeld ..... F16H 47/04 475/23
7,073,464 B2 * 7/2006 Keil ..... 119/753
7,774,873 B2 * 8/2010 Martin et al. ..... 5/81.1 R
8,074,309 B2 * 12/2011 Hutchison et al. ..... 5/610
8,291,532 B2 * 10/2012 Hornbach et al. ..... 5/611
2001/0020304 A1 * 9/2001 Roit et al. ..... 5/611
2002/0111236 A1 * 8/2002 Prince ..... 474/206
2002/0144349 A1 * 10/2002 Blyshak et al. ..... 5/614
2004/0078894 A1 * 4/2004 Snyder et al. ..... 5/11
2004/0098804 A1 * 5/2004 Varadharajulu et al. ..... 5/611
2004/0177934 A1 * 9/2004 Olmsted ..... 160/188
2005/0182289 A1 * 8/2005 Costanzo ..... 600/22
2005/0223491 A1 * 10/2005 McCrimmon ..... 5/11
2006/0219144 A1 * 10/2006 Phelan et al. ..... 114/90
2006/0260044 A1 * 11/2006 Nebel ..... 5/118
2009/0049602 A1 * 2/2009 Gudenkauf ..... 5/11
2009/0108245 A1 * 4/2009 Daus ..... B66D 1/02 254/354
2009/0320206 A1 * 12/2009 Dyreby et al. ..... 5/611
2010/0242364 A1 * 9/2010 Magro ..... 49/31
2011/0197361 A1 * 8/2011 Hornbach et al. ..... 5/618

OTHER PUBLICATIONS

European Search Report accompanied by Examiner's Preliminary Opinion, "Application No. EP 11153194", (Mar. 1, 2012), The Hague, total number of pages 5.

* cited by examiner

HEIGHT ADJUSTABLE BED FRAMEWORK WITH A LIFT CHAIN AND A PLANETARY GEAR TRAIN

TECHNICAL FIELD

The subject matter described herein relates to beds having elevation adjustable frames and particularly to a bed that effects the elevation adjustment with a lift chain driven by way of a planetary gear system.

BACKGROUND

Beds of the type used in hospitals, other health care facilities and home health care settings typically have a base frame, an elevatable frame and a lift system extending between the frames for changing the elevation of the elevatable frame relative to the base frame. One type of lift system employs a lift chain. Examples of such systems are described in pending U.S. patent application Ser. No. 12/397,511 entitled "Height Adjustable Bed with a Lift Chain Assembly and Components Thereof" and Ser. No. 12/708,178 entitled "Height Adjustable Bed with a Push Chain Assembly".

One desirable attribute of a lift system is compactness. The more compact the lift system, the more space is available for other intra-frame components or for facilitating access for cleaning, repair and maintenance. Another desirable attribute is for the resultant of the forces exerted by the lift system on the elevatable frame to be as close as possible to the lateral centerline of the bed. Such location of the resultant force helps to ensure smooth operation and reduced risk of component binding during elevation changes.

SUMMARY

A height adjustable bed framework includes a base frame, an elevatable frame, a lift chain and a power module. The lift chain is connected to the base frame or the elevatable frame and the power module is connected to the other frame. The power module includes an energy converter such as an electric motor, a planetary gear train driven by the energy converter and a chain driver, such as a sprocket, engaged with the lift chain and driven by the planetary gear train.

BRIEF DESCRIPTION OF THE DRAWINGS

The foregoing and other features of the various embodiments of the height adjustable bed frame described herein will become more apparent from the following detailed description and the accompanying drawings in which.

DETAILED DESCRIPTION

Figure 1:
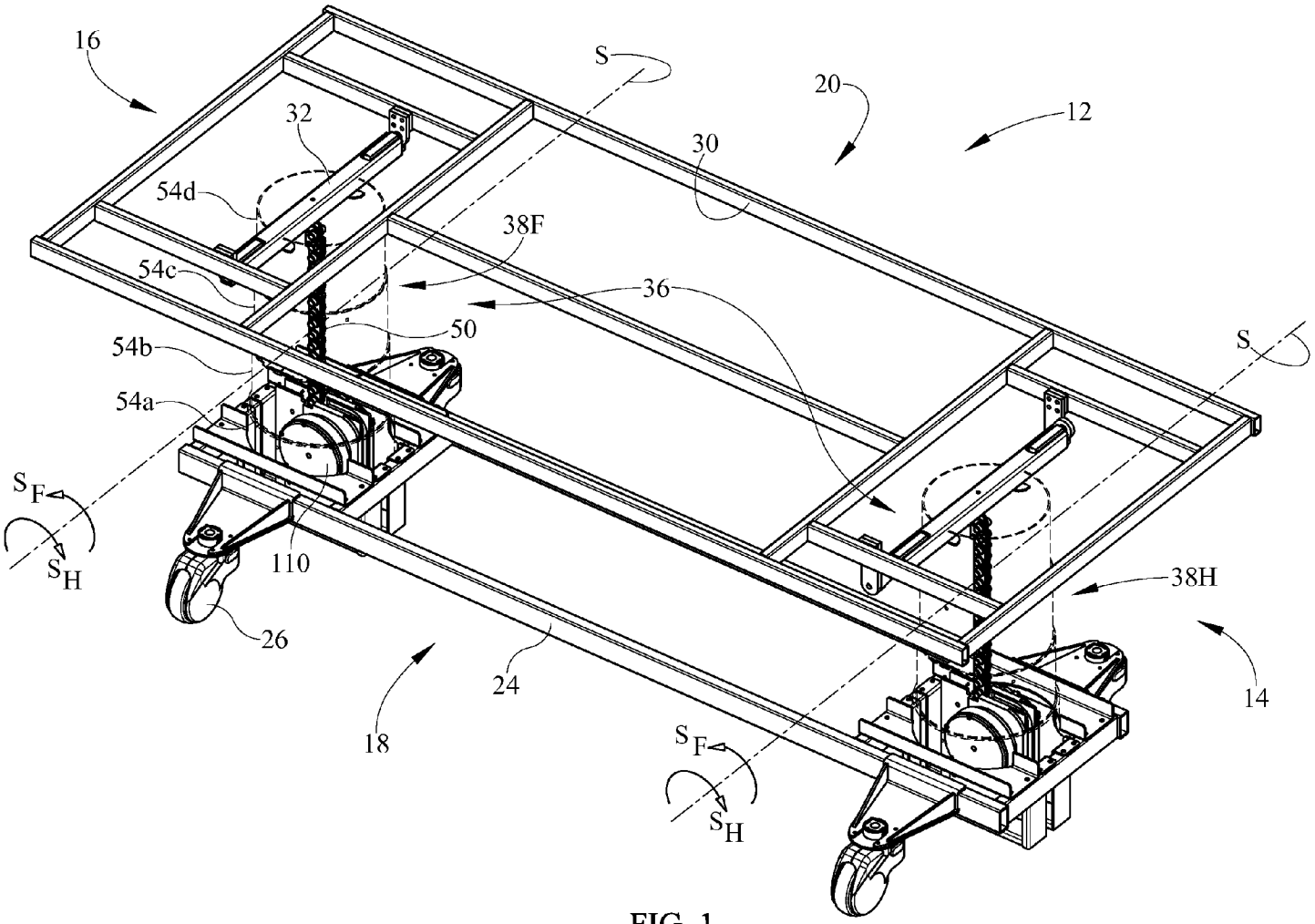
FIG. 1 is a perspective view of a bed framework including a base frame, an elevatable frame and a lift system comprised of a lift chain and a power module.

FIG. 1 shows the framework 12 of a height adjustable hospital bed. The framework extends longitudinally from a head end 14 to a foot end 16 and laterally from a left side 18 to a right side 20. The framework includes a base frame 24 with casters 26 extending to the floor, an elevatable frame 30 with a crossbar 32, and a lift system 36 for bearing the weight of the elevatable frame and changing its elevation relative to the base frame. The lift system includes head and foot end lift modules 38H, 38F. The modules are substantially identical, hence it will suffice to describe only foot end lift module 38F in detail.

Figure 2:
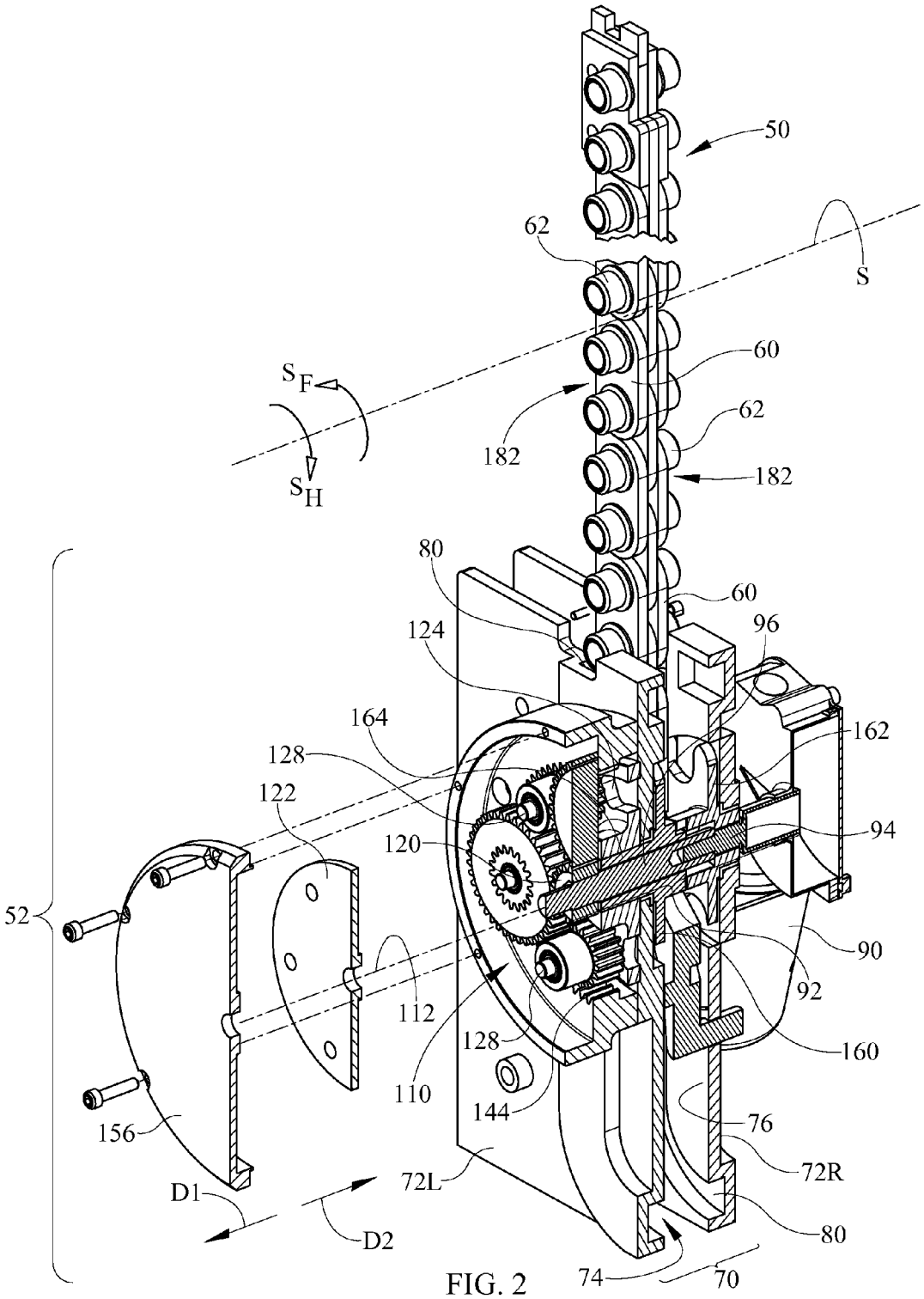
FIG. 2 is a partially exploded, cross sectional view through the power module of FIG. 1.
Figure 3:
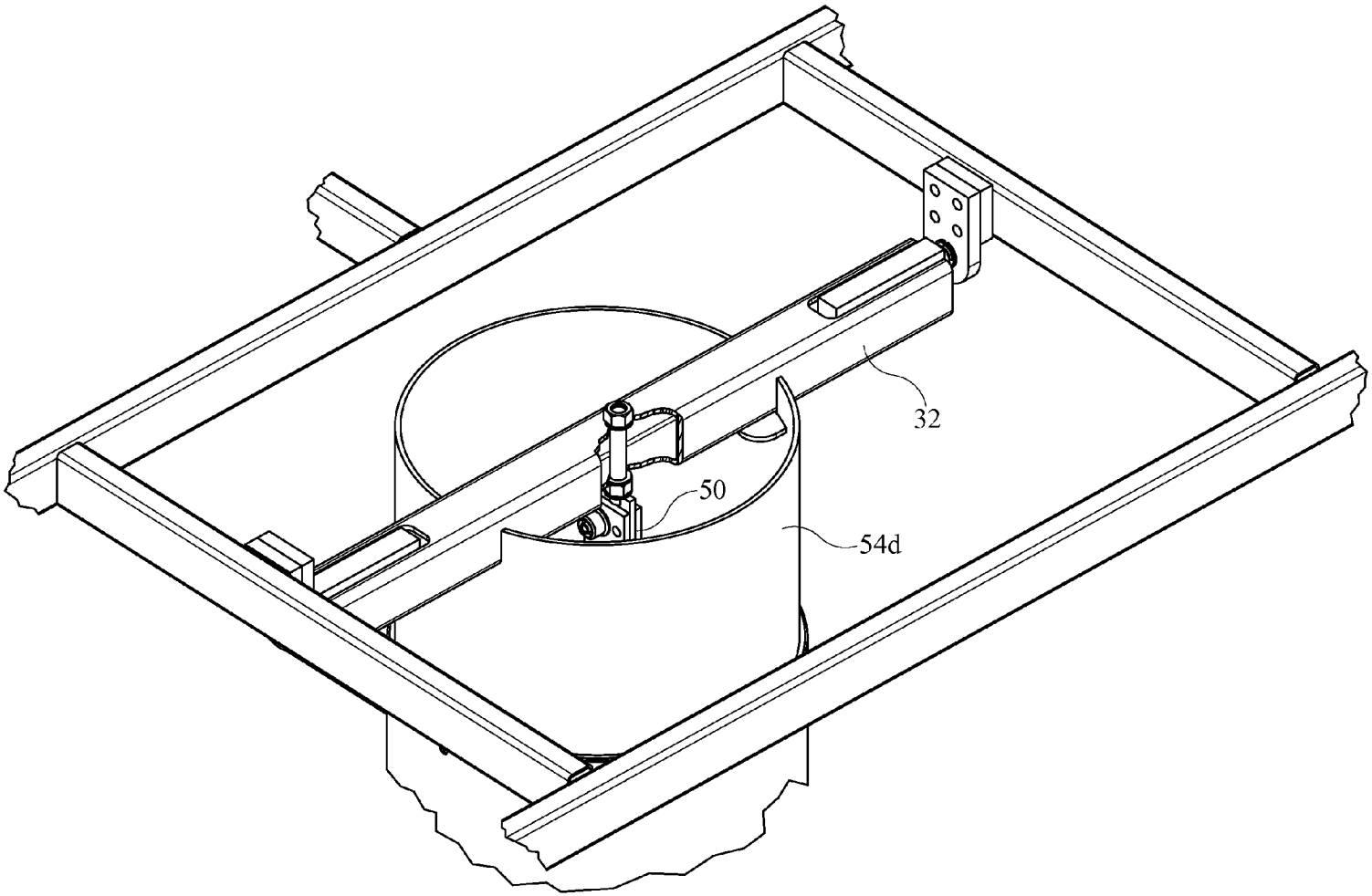
FIGS. 3 and 4 are perspective views of the foot end and head end respectively of the framework showing connections of a lift chain and a canister segment to a crossbar component of the framework.
Figure 4:
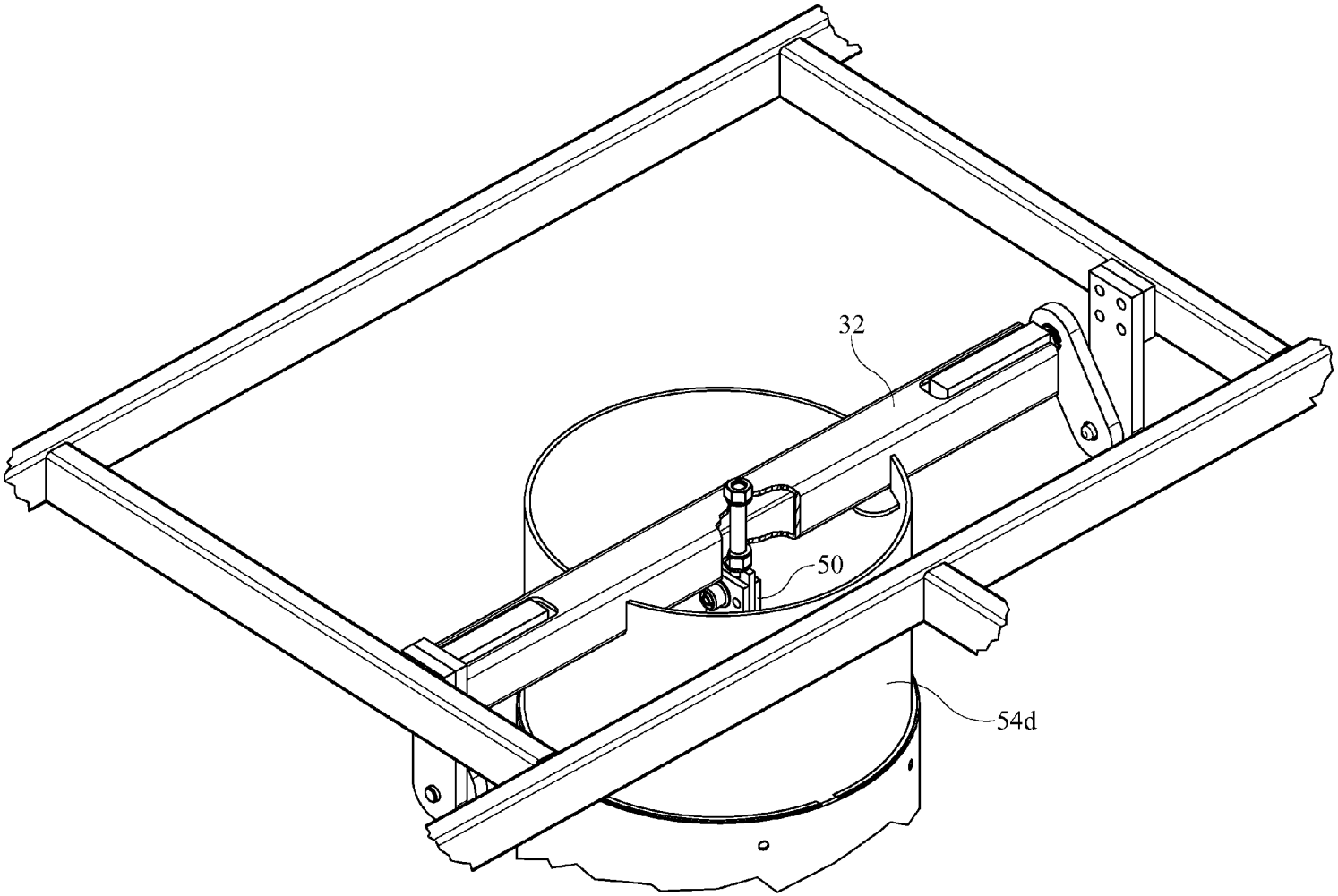

Referring additionally to FIGS. 2-4 the lift module includes a lift chain 50 connected to crossbar 32 of the elevatable frame and a power module 52 connected to the base frame. Alternatively, the power module could be connected to the elevatable frame and the lift chain to the base frame. A telescoping canister assembly 54 comprised of multiple canister segments 54*a*, 54*b*, 54*c*, 54*d* circumscribes the lift chain and power module. Uppermost canister segment 54*d* is connected to crossbar 32. The principle load path from the elevatable frame to the base frame extends through the lift chain with the canister assembly bearing a relatively small portion of the load.

Lift chain 50 is comprised of links 60 designed so that the chain can flex about a laterally extending axis, such as axis S, in only one of two rotationally opposite directions. For example the lift chain of module 38F can flex in rotational sense $S_H$ (i.e. toward the head end of the framework) but not in rotational sense $S_F$ (toward the foot end of the framework). The head end lift chain is oriented so that its flex resistance is opposite that of the foot end lift chain, i.e. so that its chain can flex in rotational sense $S_F$ but not in rotational sense $S_H$. The opposing directions of flex resistance impart stability to the elevatable frame. The lift chain also includes rollers 62 projecting laterally from the links.

Figure 5:
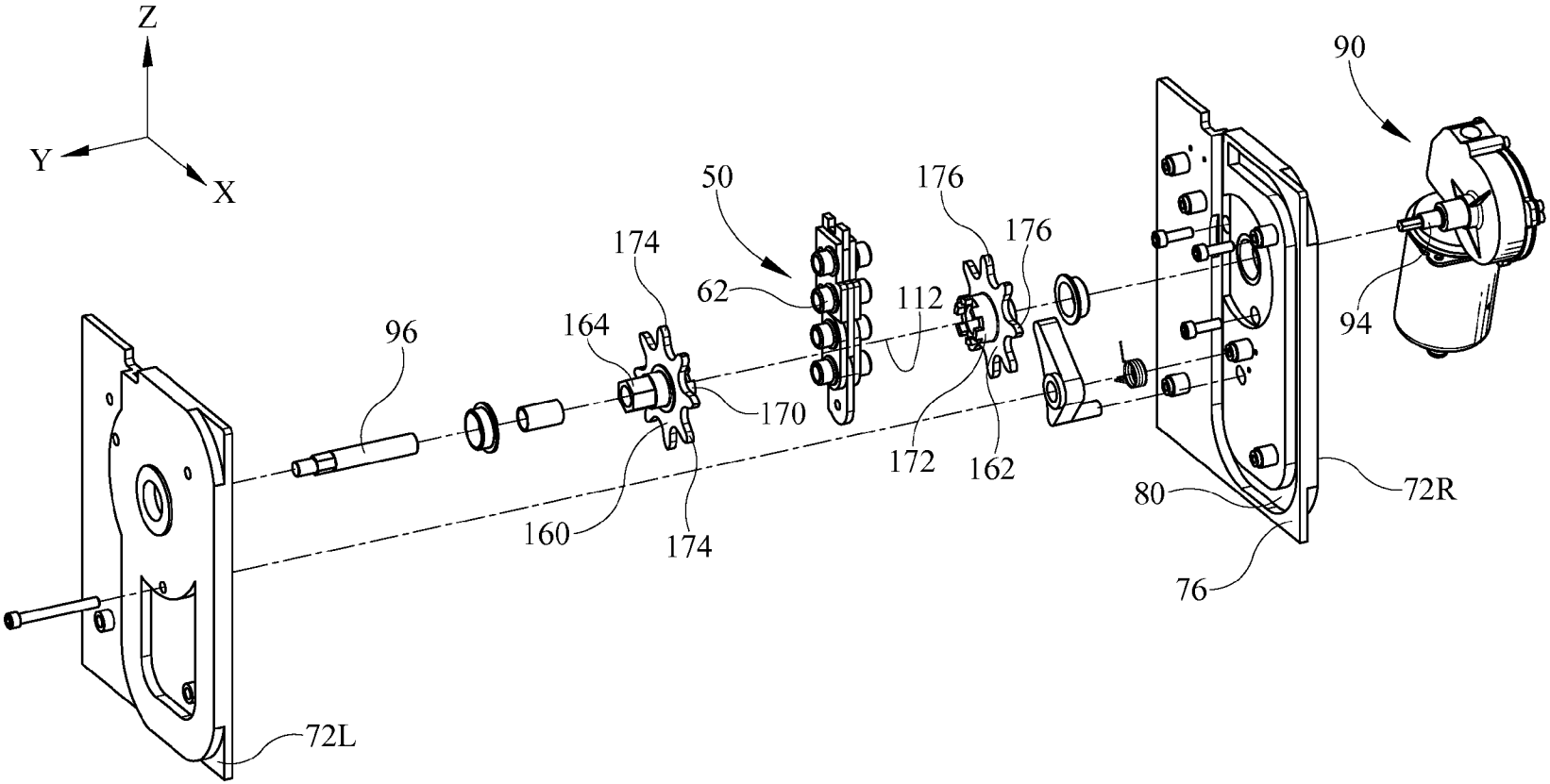
FIG. 5 is an exploded perspective view showing certain components of the power module, namely an energy converter in the form of an electric motor and a chain driver in the form of a pair of sprockets.

Referring additionally to FIG. 5 the power module also includes a chain housing 70, also referred to as a chain guide, having a left plate 72L and a right plate 72R defining a housing interior 74. Interior face 76 of each plate 72 includes a groove 80. Chain rollers 62 project into the grooves. As the elevatable frame is lowered, an increasingly larger proportion of the chain enters the housing interior 74 where the grooves 80 and chain rollers 62 cooperate to coil the chain. Conversely, when the elevatable frame is raised, the chain uncoils and progressively exits from the housing interior.

The power module also includes an energy converter such as electric motor 90 having an output shaft 92 comprising a stub shaft 94 and a shaft extension 96. The motor is mounted on an exterior side of one of the housing plates, e.g. housing plate 72R with its shaft 92 extending from the motor to a planetary gear train 110 mounted on an exterior side of the other housing plate, e.g. plate 72L. The motor shaft is rotatable about axis 112.

Figure 6:
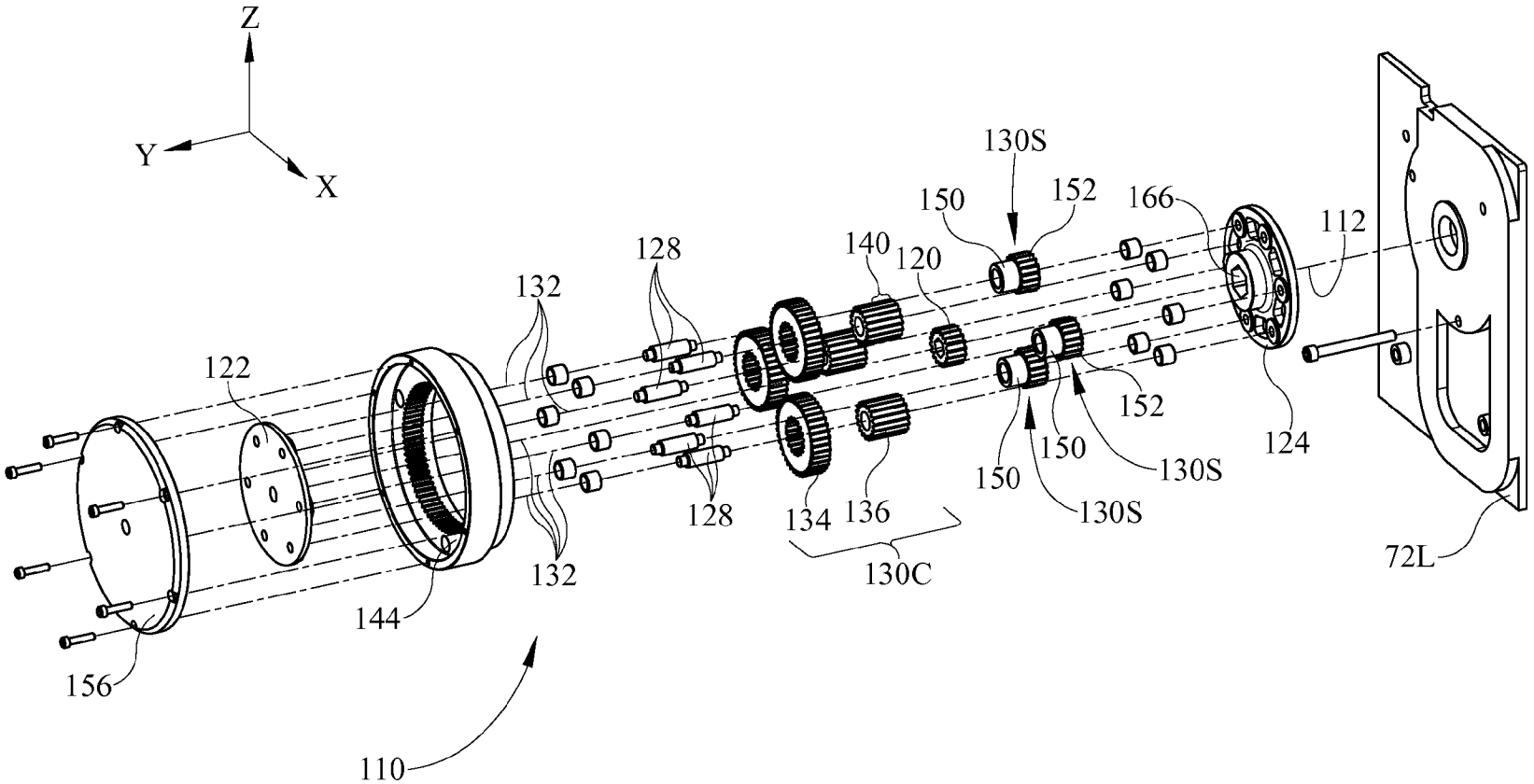
FIG. 6 is an exploded perspective view showing additional components of the power module, namely a planetary gear train comprised of a sun gear, planet gears, a ring gear, an input carrier and an output carrier.

Referring additionally to FIG. 6 the power module includes planetary gear train 110. The gear train includes a sun gear 120 connected to motor output shaft 92, an input carrier 122 and an output carrier 124. Journals 128 extend between carriers 122, 124 to rotatably mount an array of planet gears 130 for rotation about respective planet gear axes 132. The array of planet gears includes three compound planet gears 130C each having a larger diameter portion 134 meshing with the sun gear and a smaller diameter portion 136 splined or otherwise corotatably connected to the larger diameter portion. The smaller diameter portion 136 of each compound planetary gear is axially elongated relative to the large diameter portion so that it projects axially further toward output carrier 124. Projecting portion 140 of the smaller diameter portion meshes with a ring gear 144. The planet gear array also includes a set of three simple planet gears 130S circumferentially alternating with the compound planet gears. Each simple planet gear includes a smooth cylindrical portion 150 axially aligned with the sun gear and a toothed portion 152 axially aligned with the small diameter portions of the compound planet gears and meshed with the ring gear. The large diameter portion of the compound planet gears allow a relatively large speed reduction and torque amplification relative to the sun gear. The fact that the ring gear is engaged with six gears (the small diameter portions of the compound gears and the three simple gears) instead of with only the smaller diameter portions of the compound gears reduces mechanical demands on the gear train by distributing loads over a larger surface area. A retainer 156 bolted onto the ring gear housing encloses the gears and secures the gear train components together axially.

The power module also includes a chain driver in the form of one or more sprockets 160, 162. The sprockets are rotatably mounted on the chain housing axially intermediate the housing plates 72L, 72R and therefore also axially intermediate motor 90 and gear train 110. Left sprocket 160 includes an integral hexagonal sprocket shaft 164 that mates with hexagonal opening 166 in the output carrier thereby connecting the chain driver to the output carrier. Each sprocket also includes a castellated coupler 170, 172. The couplers interlock with each other to make the sprockets corotatable. The sprocket shaft 164 is coaxial with the motor output shaft 92 (which comprises stub shaft 94 and shaft extension 96) and is rotatable about axis 112. Sprocket teeth 174, 176 project into spaces 182 (FIG. 1) between neighboring chain rollers 62 thereby engaging the chain.

The compactness of the above described construction conserves intra-frame space and affords the designer considerable latitude in positioning the lift system so that forces exerted by the lift chain act on the framework as close as possible to the lateral centerline of the bed.

In operation, motor output shaft 92 conveys rotary motion of motor 90 to gear train 110 in a first direction, for example direction D1, parallel to rotational axis 112. Rotation of the motor shaft 92 causes rotation of the sun gear. The sun gear, due to its engagement with large diameter portion 134 of the compound planet gears, rotates the compound planet gears about their axes 132. The meshing engagement of the small diameter portions 136 of the compound planet gears with the ring gear causes the input carrier 122 to also rotate about axis 112 and the planet gears 130C, 130S to orbit about the axis. Journals 128 convey the rotary motion of the input carrier 122 to the output carrier 124 in a second direction D2 opposite that of the first direction D1. The rotation of the output carrier is then transferred to the sprocket shaft 164 to rotate sprockets 160, 162, thereby extending chain 50 out of the housing to raise the elevatable frame or retracting the chain into the housing to lower the elevatable frame.

Although this disclosure refers to specific embodiments, it will be understood by those skilled in the art that various changes in form and detail may be made without departing from the subject matter set forth in the accompanying claims.

We claim:

1. A height adjustable bed framework comprising:
a base frame;
an elevatable frame;
a lift system comprising a lift chain connected to one of the base frame and elevatable frame and a power module connected to the other of the base frame and elevatable frame, the power module including an energy converter, a planetary gear train driven by the energy converter and a chain driver engaged with the lift chain and driven by the planetary gear train, the planetary gear train comprising
a sun gear rotatable about a sun gear axis and;
an array of planet gears rotatably mounted on an input carrier and on an output carrier axially spaced from the input carrier for rotation about respective planet gear axes, the array of planet gears comprising compound planet gears each meshing with the sun gear and a ring gear, and simple planet gears each meshing with only the ring gear;
the output carrier being connected to the chain driver.

2. The bed framework of claim 1 wherein the energy converter is an electric motor and the chain driver is a sprocket.

3. The bed framework of claim 2 wherein the sprocket is rotatably mounted on a chain housing axially intermediate the motor and the gear train.

4. The bed framework of claim 2 including:
a chain housing having a left plate and a right plate defining a housing interior;
the sprocket being rotatably mounted on the housing intermediate the plates;
the motor being mounted on an exterior side of one of the housing plates; and
the gear train being rotatably mounted on an exterior side of the other housing plate.

5. The bed framework of claim 2 wherein rotary motion of the motor is conveyed to the gear train in a first direction; and
rotary motion of the gear train is conveyed to the sprocket in a second direction opposite that of the first direction.

6. The bed framework of claim 5 comprising a motor output shaft extending from the motor to the gear train and a sprocket shaft extending from the gear train to the sprocket, the shafts being coaxial.

7. The bed framework of claim 1 wherein the compound and simple planet gears are circumferentially alternating.

8. The bed framework of claim 7 wherein each compound planet gear has a larger diameter portion meshing with the sun gear and a smaller diameter portion meshing with the ring gear.

9. A height adjustable bed framework comprising:
a base frame;
an elevatable frame;
a lift system comprising a push chain connected to one of the base frame and elevatable frame and a power module connected to the other of the base frame and elevatable frame, the power module including an energy converter, a planetary gear train driven by the energy converter and a chain driver engaged with the push chain and driven by the planetary gear train, the chain driver being rotatable about an axis and being axially between the energy converter and the planetary gear train, the planetary gear train comprising:
a sun gear rotatable about a sun gear axis; and
an array of planet gears rotatably mounted on an input carrier and on an output carrier axially spaced from the input carrier for rotation about respective planet gear axes, the array of planet gears comprising compound planet gears each meshing with the sun gear and a ring gear and simple planet gears each meshing with only the ring gear;

the chain driver being connected to the output carrier, the chain driver comprising:

a left sprocket having a left coupler, the left sprocket being co-rotatably connected to the output carrier, a right sprocket having a right coupler engaged with the left coupler so that the sprockets corotate, the sprockets being positioned axially between a left chain housing plate and a right chain housing plate.

10. The bed framework of claim 9 wherein the energy converter is an electric motor.

11. The bed framework of claim 10 wherein:

the motor is mounted on an exterior side of one of the housing plates; and the gear train is mounted on an exterior side of the other housing plate.

12. The bed framework of claim 10 wherein rotary motion of the motor is conveyed to the gear train in a first direction; and rotary motion of the gear train is conveyed to the sprockets in a second direction opposite that of the first direction.

13. The bed framework of claim 12 comprising a motor output shaft extending from the motor to the gear train and a sprocket shaft extending from the gear train to one of the sprockets, the shafts sharing a common axis of rotation.

14. The bed framework of claim 9 wherein the compound and simple planet gears are circumferentially alternating.

15. The bed framework of claim 14 wherein each compound planet gear has a larger diameter portion meshing with the sun gear and a smaller diameter portion meshing with the ring gear.

* * * * *